US005688114A

United States Patent [19]

Millington et al.

[11] Patent Number: 5,688,114

[45] Date of Patent: Nov. 18, 1997

[54] PROGRESSING CAVITY PUMPS WITH SPLIT EXTENSION TUBES

[75] Inventors: John A. Millington, Portland, Me.; Alan G. Wild, Woodstock, Ohio

[73] Assignee: Robbins & Myers, Inc., Dayton, Ohio

[21] Appl. No.: 618,926

[22] Filed: Mar. 20, 1996

[51] Int. Cl.[6] ..... F01C 1/10; F03C 2/00

[52] U.S. Cl. ..... 418/48; 418/182; 464/157

[58] Field of Search ..... 418/48, 182; 464/149, 464/157, 159, 170

[56] References Cited

U.S. PATENT DOCUMENTS

| | | | |
|---|---|---|---|
| 1,892,217 | 12/1932 | Moineau . | |
| 2,028,407 | 1/1936 | Moineau | 103/117 |
| 2,346,426 | 4/1944 | Hait | 287/75 |
| 2,545,626 | 3/1951 | Moineau | 103/117 |
| 2,733,854 | 2/1956 | Chang | 230/148 |
| 3,011,445 | 11/1961 | Bourke | 418/48 |
| 4,591,322 | 5/1986 | Ono et al. | 418/182 |
| 4,639,200 | 1/1987 | Baumgardner et al. | 418/48 |

FOREIGN PATENT DOCUMENTS

| | | | |
|---|---|---|---|
| 2040748 | 2/1972 | Germany . | |
| 2331585 | 5/1975 | Germany | 418/48 |

*Primary Examiner*—Charles G. Freay
*Attorney, Agent, or Firm*—Biebel & French

[57] ABSTRACT

A progressing cavity pump comprises an inlet housing defining a chamber, an extension tube defining a tube interior communicating with the chamber, a stator defining an internal passageway communicating with the tube interior, a rotor positioned in the internal passageway in abutment against an inner surface of the internal passageway and a coupling at least partially enclosed by the extension tube. The coupling is connected to the rotor for actuating the rotor for rolling movement along the inner surface of the internal passageway of the stator. In an especially preferred form, the extension tube is in the form of a surface of revolution and is separable into first and second sections along a dividing plane which passes through the center of the tube. Fasteners are used to removably fasten the first and second sections to each other, the housing and the stator casing to provide access for inspection of the coupling, the rotor and the stator.

16 Claims, 4 Drawing Sheets

PROGRESSING CAVITY PUMPS WITH SPLIT EXTENSION TUBES

BACKGROUND OF THE INVENTION

1. Field of the Invention

The present invention pertains to positive displacement fluid power devices, and more particularly to progressing cavity pumps having extension tubes adapted to accommodate portions of the drive systems of the devices and to provide access to those portions of the drive systems for inspection and maintenance.

2. Description of the Related Art

Progressing cavity devices are positive displacement fluid power devices which make use of helical gear sets to provide cavities which move along a spiral path from one end of the gear set toward the other. The principles underlying progressing cavity devices are described in Moineau, U.S. Pat. No. 1,892,217, the disclosure of which is incorporated herein by reference.

Briefly stated, a progressing cavity device includes a gear set comprising a stator and a rotor. Both an inner surface of an internal passageway through the stator and an outer surface of the rotor define helical profiles. When certain geometric relationships exist between the profiles of the rotor and stator, the rotor is capable of rolling along an inner surface of the internal passageway of the stator so that an axis of the rotor moves eccentrically about an axis of the stator. This eccentric movement of the helical rotor along the inner surface of the stator creates cavities between the rotor and the stator. These cavities move progressively from one end of the stator to the other as the rotor turns.

The three-dimensional helical profiles of the rotor and stator are each defined by an envelope formed when a two-dimensional cross-sectional shape is displaced along an axis, rotated by a helix angle which is a continuous function of the displacement, and simultaneously scaled by a factor which is likewise a continuous function of the displacement. (This process may be visualized in terms of an early technique for making the rotors and stators of progressing cavity gear sets, by which flat discs were stacked upon each other, with the discs stepped with respect to one another in a helical arrangement.) The rotor and stator profiles must meet certain geometric relationships with respect to each other to permit the rotor to move eccentrically along the inner surface of the stator.

The gear set acts as a pump when fluid or slurry is imbibed into a cavity at one end of the stator and the rotor is turned to move that cavity toward the opposite end of the stator. The gear set serves as an actuator when fluid or slurry is driven through the gear set under pressure, thereby inducing the rotor to turn.

Since the rotor must roll eccentrically along the inner surface of the stator, some form of coupling must be provided to transmit power from a drive shaft with a fixed axis to the eccentrically-moving rotor. Various forms of couplings have been proposed for this purpose in the past, including crank arms (Moineau, U.S. Pat. No. 1,892,217), flexible couplers (Moineau, U.S. Pat. No. 2,346,246) and universal joints (Chang, U.S. Pat. No. 2,733,854).

Typically, these couplings are high maintenance items requiring periodic access. Furthermore, the rotor and stator themselves are high wear items which require periodic inspection. Since the housing which encloses the fluid power device must be fluid-tight, it is preferred that as little of the housing be disassembled as necessary to perform routine maintenance and inspection. There remains a need in the art for progressing cavity fluid power devices configured to provide access to the couplings, the rotor and the stator with minimal disassembly of the apparatus housing.

SUMMARY OF THE INVENTION

These and other objects are met by the improved pump disclosed herein.

Briefly, the invention includes an inlet housing, an extension tube and a stator casing. The inlet housing defines a chamber and a suction port communicating with the chamber. The extension tube is in the form of a cylinder or a surface of revolution. It is removably fastened to the inlet housing and defines a tube interior which communicates with the inlet chamber. The stator casing is removably fastened to the extension tube.

The pump also includes a stator and a rotor. The stator is enclosed in the stator casing. It defines an internal passageway communicating with the tube interior. The internal passageway defines a helical inner surface. The rotor, which is positioned in the internal passageway in abutment against the inner wall, defines a helical outer surface.

Preferably, certain geometric relationships exist between the "pitches" and "thread numbers" of the rotor and stator. For this purpose, the "pitch" of a helical profile is defined as the displacement along the axis in which the cross-section is rotated by 360°. The "thread number" of the rotor is the number of worm threads on the outer surface of the rotor, while the "thread number" of the stator is the number of lobes in the cross-section of the stator for receiving worm threads. Preferably, the internal passageway of the stator has a stator pitch which is less than the length of the stator. In addition, the stator thread number is one greater than the rotor thread number, and the ratio of the rotor pitch to the stator pitch equals a ratio of the rotor thread number to the stator thread number. These geometric relationships facilitate the eccentric movement of the rotor against the inner surface of the stator.

The rotor is supported by means of a coupling which, in preferred form, transmits power (i.e., thrust and torque) from a drive shaft aligned with the stator axis to the rotor. The preferred coupling includes a first universal joint, a connecting rod and a second universal joint. The first universal joint, which transfers power from the drive shaft to the connecting rod, is often positioned in the chamber of the inlet housing. The connecting rod extends into the extension tube, where it is connected to the second universal joint. In addition, the second universal joint is connected to the rotor for rolling movement along the inner surface of the internal passageway of the stator.

The extension tube includes two sections separable along a dividing plane which includes the longitudinal axis of the extension tube, each of the two sections being removably fastened to the inlet housing and to the stator casing. In an especially preferred form, the two sections are removably fastened together and are fastened to the housing and to the stator casing by means of threaded fasteners.

It has been found that the placement of the cylindrical extension tube between the inlet housing and the progressive cavity gear set, and the extension of the connecting rod between the drive shaft and the rotor into the extension tube, improves the efficiency of certain designs of pumps as well as the flow of semi-dry materials.

Furthermore, since the first universal joint and the connecting rod are both at least partially enclosed in the extension tube, removal of one of the sections of the extension tube exposes the first universal joint and the connecting rod for inspection and maintenance. Since each of the sections preferably constitutes half of the shell enclosing the tube interior, removal of one of the sections provides a sufficient opening to visually inspect the rotor and stator through an upstream end of the internal passageway.

Therefore, it is one object of the invention to provide fluid power apparatus providing access to high maintenance parts in the apparatus drive.

The invention will be further described in conjunction with the appended drawings and following detailed description.

DETAILED DESCRIPTION OF THE PREFERRED EMBODIMENTS

Figure 1:
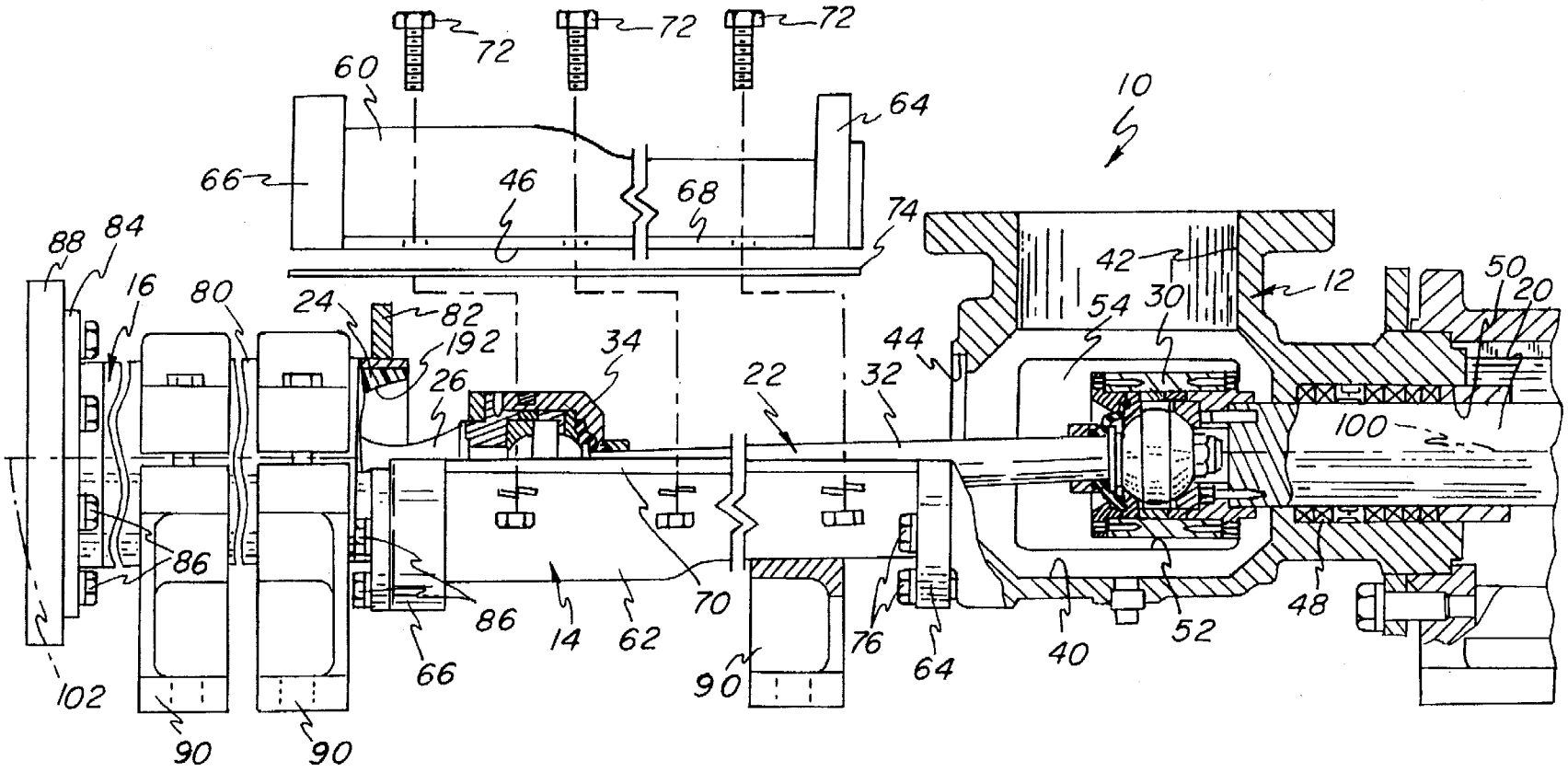
FIG. 1 is a partially-sectioned side elevational view of a first embodiment of an improved pump according to the present invention.

Turning now to FIG. 1, there is shown a pump 10 designed for pumping low to high viscosity fluids and slurries. The pump 10 includes an inlet housing 12, an extension tube 14 and a stator casing or housing 16. At least partially enclosed within these elements are a drive shaft 20, a coupling 22, a stator 24 and a rotor 26. The coupling 22 includes a first universal joint 30, a connecting rod 32 and a second universal joint 34.

The inlet housing 12 defines a chamber 40 and a suction port 42 which communicates with the chamber 40. The suction port 42 is configured to mate to standard pipe fittings. At one end of the chamber 40, an opening 44 communicates with a tube interior 46 of the extension tube 14. At an opposite end of the chamber 40, the drive shaft 20 extends into the chamber 40 through a packing or shaft sealing device 48 mounted in a stuffing box or seal housing 50. The inlet housing 12 includes an access port 52 sealed by a removable door 54 which provides access to the first universal joint 30 for inspection and maintenance.

The extension tube 14 includes a first or removable section 60 and a second section 62 which may be fixed or removable. The first and second sections 60, 62 each define substantially semi-circular upstream flange portions 64 and substantially semi-circular downstream flange portions 66 which cooperate to form radial upstream and downstream flanges near opposite ends of the extension tube 14. The upstream flange portions 64 preferably comprise ring portions or flanges located extending around outer surfaces of the first and second sections 60, 62.

The first and second sections 60, 62 also include longitudinally extending side flanges 68, 70 which are fastened together by threaded fasteners 72 to form the extension tube 14. A gasket 74 is positioned between the side flanges 68, 70 to seal the assembled extension tube 14. When the pump 10 is assembled, the upstream flange portions 64 are removably fastened to the inlet housing 12 by means of threaded fasteners 76.

The stator casing 16 consists primarily of a cylindrical shell 80 which at least partially encloses the stator 24. A first ring 82 is attached to an outer surface of the shell 80 near an upstream end while a second ring 84 is attached to the outer surface of the shell 80 near a downstream end. When the pump 10 is assembled, the downstream flange portions 66 of the extension tube 14 are removably fastened by means of threaded fasteners 86 to the first ring 82 so that the extension tube 14 is attached to the stator casing 16. At the other end, a standard discharge flange 88 defining a discharge port (not shown) is fastened to the second ring 84. The stator casing 16, as well as the extension tube 14, is embraced by a plurality of brackets 90 which mount the pump 10 on a substrate (not shown).

The drive shaft 20 consists of a solid metal shaft supported by bearings (not shown) and located for rotation about a fixed axis 100 aligned with an axis 102 of the stator 24. The drive shaft 20 is coupled near one end to a drive head (not shown) and near an opposite end to the first universal joint 30. In operation, the drive shaft 20 transfers rotary power from the drive head (not shown) to the coupling 22.

Figure 2:
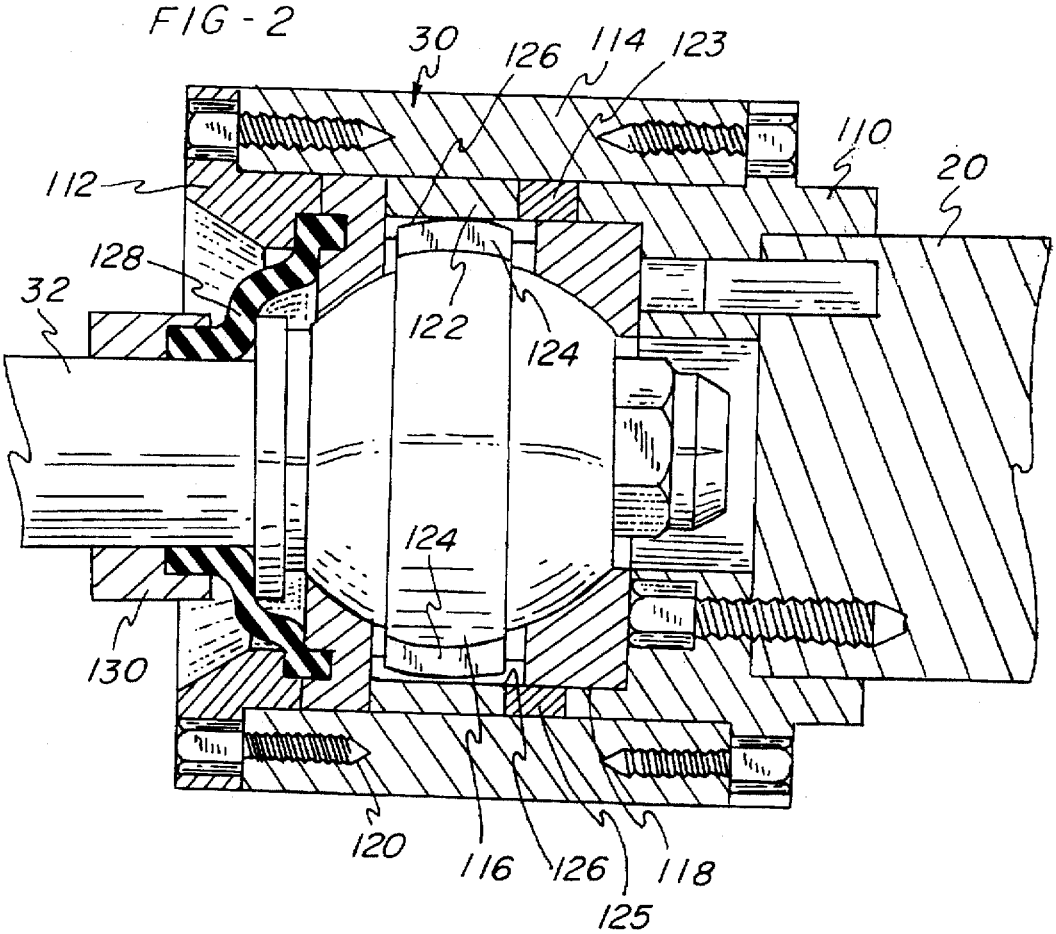
FIG. 2 is an enlarged sectional view of an example of a first universal joint for use in the pump of FIG. 1.

One example of first and second universal joints 30, 34 of the coupling 22 comprise gear joints. As best shown in FIG. 2, the first universal joint 30 includes a first retainer 110 coupled to the drive shaft 20, a second retainer 112, a sleeve 114 which spaces the first and second retainers 110, 112 to form a socket, and a gear ball 116 coupled to the connecting rod 32.

Thrust plates 118, 120 separated by a ring gear 122 restrain the gear ball 116 to pivot within a limited angle. The gear ball 116 includes external crowned gear teeth 124 and the ring gear 122 includes straight internal gear teeth 126 which receive the external teeth 124 such that the gear ball 116 rotates with the sleeve 114. In addition, a pair of keys 123, 125 connect the first retainer 110 to the ring gear 122. Thus, rotary power from the drive shaft 20 is transferred through the first retainer 110, the keys 123, 125 and the ring gear 122 to the gear ball 116, and thence to the connecting rod 32. A seal 128 captured on an outer periphery between the second retainer 112 and the thrust plate 120, and on an inner periphery between the connecting rod 32 and a collar 130, protects the universal joint 30 from the fluid or slurry in the chamber 40.

Figure 3:
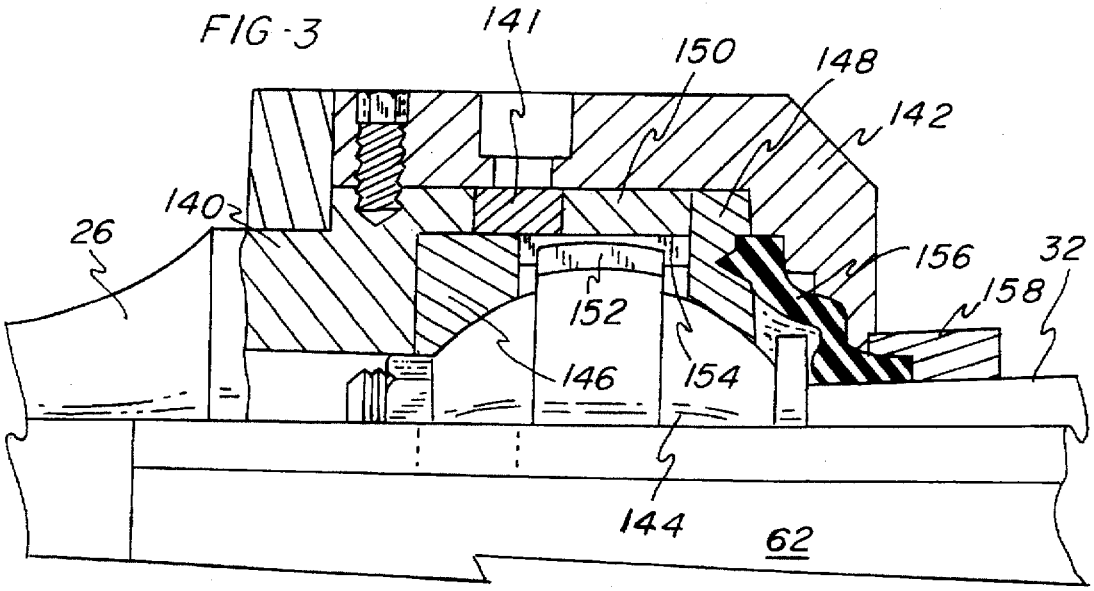
FIG. 3 is an enlarged partial sectional view of an example of a second universal joint for use in the pump of FIG. 1 positioned in an extension tube of the pump.

The second universal joint 34 is similar in construction to the first universal joint 30. As best shown in FIG. 3, the second universal joint 34 includes a first retainer 140 which is typically formed integrally with the rotor 26, a second retainer 142, and a gear ball 144 coupled to the connecting rod 32 near an end of the connecting rod 32 opposite the first universal joint 30. The second retainer 142 of the second universal joint 34 is cup-shaped and is coupled directly to the first retainer 140 to define a socket in which the gear ball 144 is positioned.

As in the first universal joint 30, the second universal joint 34 includes thrust plates 146, 148 located on either side of a gear ball 144 to pivot within a limited angle. The gear ball 144 includes external crowned gear teeth 152 (only one shown) and a ring gear 150 includes straight internal gear teeth 154 which receive external teeth 152 such that the gear ball 144 rotates with the second retainer 142. In addition, a pair of keys 141 (only one shown) provide a connection between the ring gear 150 and the first retainer 140. A seal 156 is captured on an outer periphery between the second retainer 142 and the thrust plate 148, and on an inner periphery between the connecting rod 32 and a collar 158.

Returning to FIG. 1, the first and second universal joints 30, 34 and the connecting rod 32 cooperate to transfer rotary power from the axis 100 of the drive shaft 20 (which coincides with the stator axis 102) to the rotor 26. The first universal joint 30 couples the drive shaft 20 and the connecting rod 32 in the chamber 40 of the inlet housing 12. The second universal joint 34 couples the connecting rod 32 to the rotor 26 in the extension tube 14. Since the connecting rod 32 is fixed to the gear ball elements 116 (FIG. 2) and 144 (FIG. 3) of the universal joints 30, 34 while the drive shaft 20 and the rotor 26 are fixed to the first retainers 110 (FIG. 2) and 140 (FIG. 3), respectively, of the universal joints 30, 34, the connecting rod 32 may pivot through a limited angle relative to the axis 100 of the drive shaft 20 to permit the rotor 26 to move eccentrically about the stator axis 102.

Figure 4:
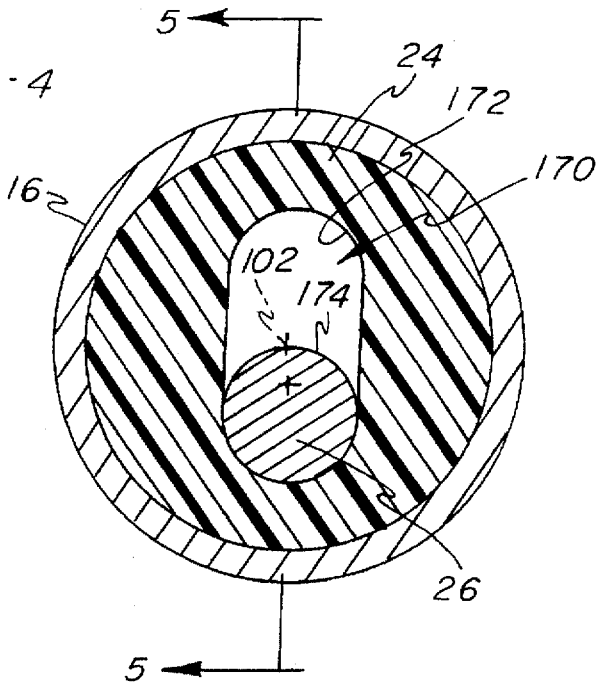
FIG. 4 is a sectional view of a stator casing, stator and rotor for the pump of FIG. 1.
Figure 5:
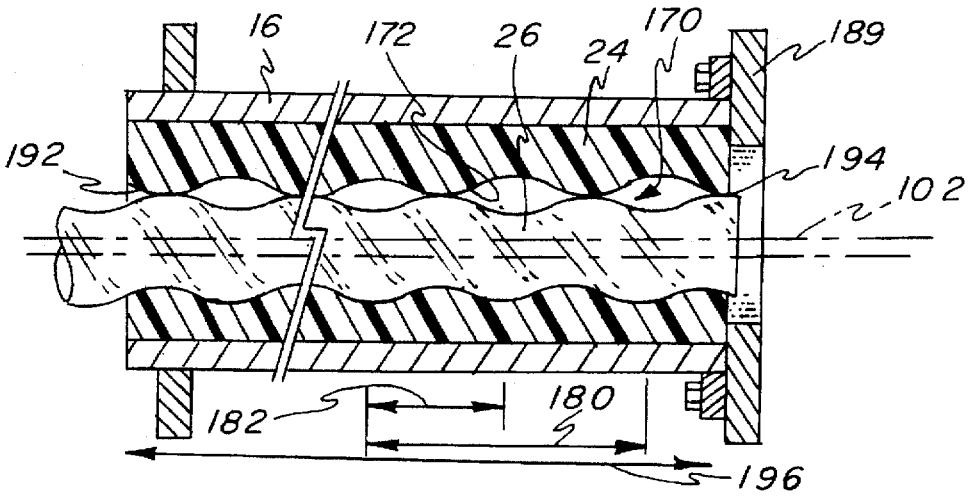
FIG. 5 is a sectional view of the stator casing, stator and rotor of FIG. 4, taken along the line 5—5 in FIG. 4.

The stator 24 and the rotor 26 preferably form a progressing cavity gear set. As best shown in FIGS. 4 and 5, the stator 24 comprises an elastomeric sleeve defining an internal passageway 170 which communicates with the extension tube 14 (FIG. 1). The internal passageway 170 defines an inner surface 172. The stator 24 is enclosed in the stator casing 16 in abutment against the discharge flange 88 (FIG. 5). The rotor 26 comprises a worm formed from metal or composite material having an outer surface 174. The rotor 26 abuts against the inner surface 172 of the stator 24, and is connected to the coupling 22 for eccentric movement along the inner surface 172 as power is transferred from the drive shaft 20 (FIG. 1) through the coupling 22 to the rotor 26.

The inner surface 172 of the stator 24 and the outer surface 174 of the rotor 26 each define helical profiles. The helical profiles are preferably derived from cross-sections generated from a combination of line segments, circular arcs and hypocycloidal arcs, and are subject to certain geometric relations which permit the rotor 26 to mesh in the internal passageway 170 of the stator 24.

As best shown in FIG. 4, one of these geometric relationships is that a "stator thread number" be one greater than a "rotor thread number." The "rotor thread number" is the number of worm threads on the outer surface of the rotor, while the "stator thread number" is the number of lobes in the cross-section of the stator for receiving worm threads. The rotor 26 shown in FIG. 4 has one thread, while the cross-section of the internal passageway 170 shown in FIG. 4 has two lobes for receiving that thread. Thus, the thread number of the stator is two and the thread number of the rotor is one.

Another of these geometric relationships is that the ratio of the rotor pitch to the stator pitch preferably equals the ratio of the rotor thread number to the stator thread number. In FIG. 5, the stator pitch is indicated at 180 and the rotor pitch is indicated at 182. The rotor pitch 182 is one-half the stator pitch 180, which corresponds to the 1:2 ratio between the rotor thread number and the stator thread number.

In operation, the interaction of the helical profiles of the inner surface 172 of the stator 24 and the outer surface 174 of the rotor 26 produces a series of cavities in the internal passageway 170. When power transferred from the drive shaft 20 through the coupling 22 causes the rotor 26 to rotate eccentrically along the inner surface 174 of the stator 24, these cavities move from an upstream end 192 of the internal passageway 172 toward a downstream end 194. Fluid or slurry enters into the cavities near an upstream end 192 of the internal passageway 172 facing the extension tube 14 (FIG. 1) and is carried toward the downstream end 194. The flow of the fluid or slurry into the cavities creates a pressure gradient which draws additional fluid or slurry through the suction port 42, the chamber 40 and the tube interior 46 toward the internal passageway 172.

The stator length 196 should be greater than the stator pitch 180. This relationship prevents the cavities in the passageway 170 from communicating simultaneously with both the upstream and downstream ends 192, 194 of the internal passageway 170 and thereby equalizing pressure across the internal passageway 170.

Figure 6:
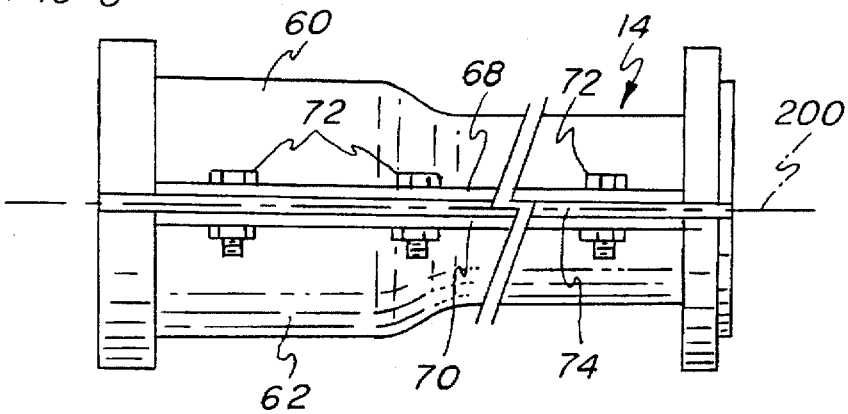
FIG. 6 is a side elevational view of an extension tube for the pump of FIG. 1.

In order to facilitate inspection and maintenance of the coupling 22, the stator 24 and the rotor 26, the extension tube 14 is formed from first and second sections 60, 62 separable along a dividing plane generally dividing the extension tube 14 into upper and lower halves. As best shown in FIG. 6, the extension tube 14 is preferably in the form of a surface of rotation with a tube axis 200. The side flanges 68, 70 of the first and second sections 60, 62 of the extension tube 14 abut the gasket 74 along the dividing plane, which includes the tube axis 200 and is perpendicular to the plane of the drawing. When the threaded fasteners 72 are removed, the first and second sections 60, 62 are separable along this plane. It should be noted that instead of the threaded fasteners discussed above, toggle clamps or other quick acting mechanical fasteners could also be used to facilitate quick attachment and detachment of the sections 60, 62 to and from each other.

Returning to FIG. 1, the separation of the first section 60 of the extension tube 14 from the second section 62 exposes the connecting rod 32 and the second universal joint 34 for inspection and maintenance. Furthermore, the removal of the first section 60 creates a sufficient opening for maintenance personnel to inspect the rotor 26 and the stator 24 through the upstream end 192 of the stator 24. It should be noted that although the universal joints 30, 34 have been described with particular reference to gear joints, the split extension tube of the present invention may be used to facilitate maintenance on any type of drive mechanism.

Figure 7:
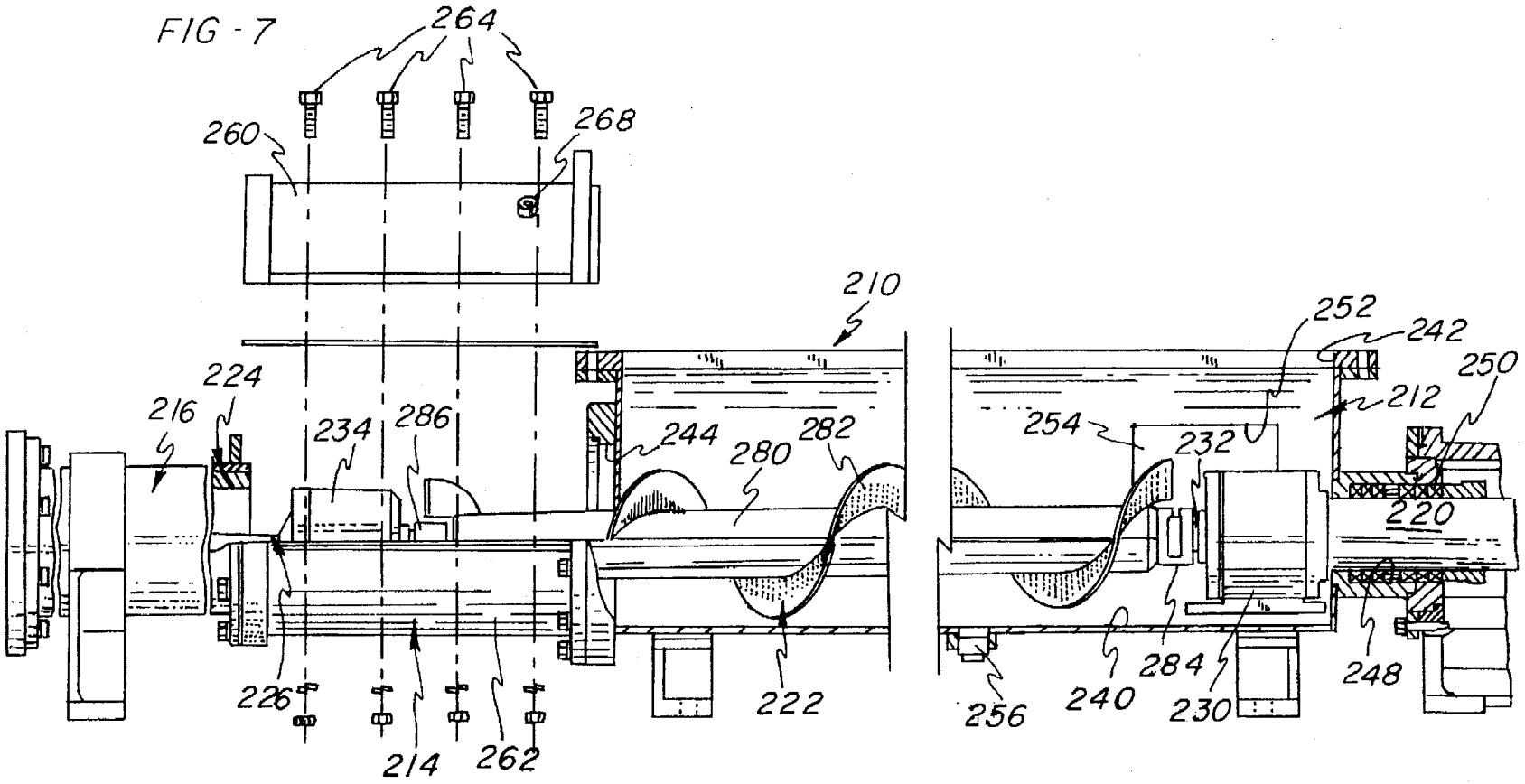
FIG. 7 is a partially-sectioned side elevational view of a second embodiment of an improved pump according to the present invention.

FIG. 7 shows a so-called "open-throat" pump 210 designed to connect to the bottom of a large hopper or feed chute to pump highly viscous products or semi-dry materials such as filter cakes or paper stock. The pump 210 includes an inlet housing 212, an extension tube 214 and a stator casing 216. At least partially enclosed within these elements are a drive shaft 220, a coupling 222, a stator 224 and a rotor 226. The coupling 222 includes a first universal joint 230, a connecting rod 232 and a second universal joint 234. The stator casing 216, the drive shaft 220, the stator 224 and the rotor 226 are identical in construction to their counterparts 16, 20, 24 and 26 in the pump 10 of FIGS. 1–6, and will not be described further.

The inlet housing 212 defines a elongated prismatic chamber 240 and a rectangular suction port 242 which is essentially an open upper side of the chamber 240. At one end of the chamber 240, an opening 244 communicates with the extension tube 214. At an opposite end of the chamber 240, the drive shaft 220 extends into the chamber 240 through a shaft sealing device 248 mounted in a stuffing box or seal housing 250. The inlet housing 214 also includes an access port 252 sealed by a removable door 254 which provides access to the first universal joint 230 for inspection and maintenance. A plug 256 is provided at the bottom of the inlet housing 212 for drainage.

The extension tube 214 includes a first or removable section 260 and a second or fixed section 262. As with the extension tube 14 of the pump 10, the first and second sections 260, 262 are separable along a dividing plane and are removably fastened to each other, to the inlet housing 212 and to the stator casing 216 by means of threaded fasteners 264. The assembled extension tube 214 is cylindrical in shape, and includes an inspection port 268.

The connecting rod 232 extends across most of the length of the inlet housing 212 and the extension tube 214. The connecting rod 232 supports a sleeve 280 having a helical worm or auger 282 which serves to agitate material which accumulates at the bottom of the inlet housing 212 and to drive such material into the extension tube 214. The sleeve 280 is secured to the connecting rod 232 at either end by collars 284, 286 which induce the worm 282 to rotate with the connecting rod 232. It has been found that the placement of the cylindrical extension tube 214 between the inlet housing 212 and the gear set 224, 226, and the extension of the connecting rod 232 with the worm 282 into the extension tube 214, improves the efficiency of the pump 210 as well as the feed of semi-dry materials to the gear set 224, 226.

Furthermore, the separation of the extension tubes 14, 214 of the two embodiments 10, 210 into sections 60, 62, 260, 262 removably fastened together by threaded fasteners facilitates the inspection and maintenance of the couplings 22, 222; the stators 24, 224 and the rotors 26, 226 of the two embodiments 10, 210.

While the forms of apparatus herein described constitute preferred embodiments of the invention, it should be understood that the invention is not limited to these precise forms of apparatus, and that changes may be made therein without departing from the scope of the invention, which is defined in the appended claims.

What is claimed is:

1. A pump assembly comprising:

a pump housing;

a rotor located within said pump housing, said rotor being supported for rotating eccentric movement within said pump housing;

a coupling connected to said rotor for actuating the rotor in said rotating movement;

an extension tube surrounding at least a portion of said coupling;

wherein said extension tube comprises first and second sections, said first section being removably jointed to said second section to facilitate access to said coupling; and including an inlet housing defining a chamber for receiving material to be conveyed to said pump housing, said extension tube defining opposing upstream and downstream extension tube ends wherein said upstream extension tube end is attached to said inlet housing and said downstream extension tube end is attached to said pump housing.

2. The pump assembly as recited in claim 1 wherein said extension tube defines a longitudinal axis and said first and second second sections are joined along a dividing plane extending parallel to said longitudinal axis.

3. The pump assembly as recited in claim 2 wherein said dividing plane extends through said longitudinal axis.

4. The pump assembly as recited in claim 1 wherein said extension tube is a cylindrical member.

5. The pump assembly as recited in claim 1 wherein each of said first and second sections define appoximately half of said extension tube.

6. The pump assembly as recited in claim 1 wherein said extension tube defines a longitudinal axis and said first and second sections are joined along a dividing plane extending parallel to said longitudinal axis.

7. The pump assembly as recited in claim 1 wherein said first and second sections each include a substantially semi-circular flange portion at said upstream extension tube end for attaching said extension tube to said inlet housing, and said first and second sections each include a substantially semi-circular flange portion at said downstream extension tube end for attaching said extension tube to said pump housing.

8. The pump assembly as recited in claim 7 including longitudinal flanges extending along said first and second sections between said upstream and downstream extension tube ends and including fasteners extending through said longitudinal flanges to fasten said first section to said second section.

9. The pump assembly as recited in claim 1 including a drive shaft supported for rotation by said inlet housing and defining a drive shaft axis, said coupling including a first universal coupling member connected to said drive shaft, a connecting rod having a first end connected to said first universal coupling member and a second end, and a second universal coupling member connected to said second end of said connecting rod, said second universal coupling member being connected to said rotor whereby said coupling is adapted to accomodate eccentric movement of said rotor relative to said drive shaft axis.

10. The pump assembly as recited in claim 1 including a stator located within said pump housing wherein said stator and said rotor define a progressing cavity pump.

11. A pump assembly comprising:

an inlet housing defining a chamber and a suction port communicating with the chamber;

a extension tube in the form of a surface of revolution removably fastened to the inlet housing, the extension tube defining a longitudinal tube axis and a tube interior communicating with the chamber;

a stator casing removably fastened to the extension tube;

a resilient stator at least partially enclosed in the stator casing, the stator defining an internal passageway communicating with the tube interior, the internal passageway defining a helical inner surface, a stator axis, a stator length measured along the stator axis and an internal passageway cross-section normal to the stator axis;

a rotor positioned in the internal passageway in abutment against the inner surface, the rotor defining a helical outer surface and a rotor cross-section;

a drive shaft at least partially enclosed by the inlet housing;

a first universal coupling connected to the drive shaft in the chamber;

a connecting rod defining a first end positioned in the chamber and a second end positioned in the extension tube, the connecting rod being connected to the first universal coupling near the first end of the connecting rod in the chamber;

a second universal coupling connected to the connecting rod near the second end of the connecting rod in the extension tube, the second universal coupling being connected to the rotor for actuating the rotor for eccentric movement along the inner surface of the internal passageway; and wherein the extension tube includes two sections separable along a dividing plane which includes the tube axis, each of the two sections being removably fastened to the inlet housing and the stator casing.

12. The apparatus as recited in claim 11 wherein the extension tube is cylindrical and the connecting rod supports a worm for feeding material toward the internal passageway.

13. The apparatus as recited in claim 11 wherein the two sections of the extension tube are removably fastened together, and fastened to the inlet housing and to the stator casing by means of threaded fasteners.

14. The apparatus as recited in claim 11 wherein said stator and said rotor define a progressing cavity pump for pumping material conveyed through said extension tube from said inlet housing.

15. A pump assembly comprising:

an inlet housing defining a chamber;

a cylindrical extension tube defining a tube interior communicating with the chamber;

a stator defining an internal passageway communicating with the tube interior, the internal passageway defining a helical inner surface, a stator length, a stator pitch less than the stator length and an internal passageway cross-section having a stator thread number;

a rotor positioned in the internal passageway in abutment against the inner surface, the rotor defining a helical outer surface and a rotor cross-section;

wherein the rotor defines a rotor pitch, the rotor cross-section defines a rotor thread number, the stator thread number is one greater than the rotor thread number and a ratio of the rotor pitch to the stator pitch equals a ratio of the rotor thread number to the stator thread number;

a drive shaft at least partially enclosed by the inlet housing;

a first universal coupling connected to the drive shaft in the chamber;

a connecting rod connected to the first universal coupling in the chamber; and a second universal coupling connected to the connecting rod in the extension tube, the second universal coupling being connected to the rotor for actuating to rotor for eccentric movement along the inner surface of the internal passageway.

16. The apparatus as recited in claim 15 wherein the extension tube includes two sections separable along a dividing plane, each of the two sections being removably fastened to the inlet housing and the stator casing.

* * * * *